US009086202B2

(12) United States Patent
Rottstaedt

(10) Patent No.: US 9,086,202 B2
(45) Date of Patent: Jul. 21, 2015

(54) LIGHT MODULE HAVING AN APERTURE WITH A RESILIENT STOP ELEMENT

(75) Inventor: Olaf Rottstaedt, Emsetal-Fischbach (DE)

(73) Assignee: AUTOMOTIVE LIGHTING REUTLINGEN GMBH, Reutlingen (DE)

( * ) Notice: Subject to any disclaimer, the term of this patent is extended or adjusted under 35 U.S.C. 154(b) by 386 days.

(21) Appl. No.: 13/456,942

(22) Filed: Apr. 26, 2012

(65) Prior Publication Data

US 2012/0275161 A1 Nov. 1, 2012

(30) Foreign Application Priority Data

Apr. 27, 2011 (DE) ..... 20 2011 005 617 U
Apr. 13, 2012 (DE) ..... 10 2012 206 029

(51) Int. Cl.
*F21S 8/12* (2006.01)
*F21S 8/10* (2006.01)

(52) U.S. Cl.
CPC ..... *F21S 48/1778* (2013.01)

(58) Field of Classification Search
CPC ..... F21S 48/1778–48/1794; F16F 2232/00–2232/08; F16F 15/00–15/366; F21L 2/00; F21W 2101/00–2101/14
USPC ..... 362/507, 277–289, 296.01–296.1, 362/464–468, 512–516, 538–539
See application file for complete search history.

(56) References Cited

U.S. PATENT DOCUMENTS 7,568,825 B2 * 8/2009 Louvet et al. ..... 362/539
2005/0024889 A1 * 2/2005 Sugimoto ..... 362/539

FOREIGN PATENT DOCUMENTS

DE 102010062278 A1 6/2012

* cited by examiner

*Primary Examiner* — Karabi Guharay
*Assistant Examiner* — Nathaniel Lee
(74) *Attorney, Agent, or Firm* — Howard & Howard Attorneys PLLC

(57) ABSTRACT

A projection light module having a light source, primary optics, secondary optics and a movable aperture, which is arranged in such a way that the primary optics transfer lighting current emanating from the light source in a first light distribution which is situated in a focal plane of the secondary optics so that the secondary optics transfer the first light distribution in a second light distribution situated in the front end of the light module, which is equipped to displace an optically effective edge of the aperture by actuating the aperture between a first control position and a second control position, wherein at least the second control position is defined by a mechanical limit stop. The aperture includes at least a resilient stop element.

8 Claims, 3 Drawing Sheets

LIGHT MODULE HAVING AN APERTURE WITH A RESILIENT STOP ELEMENT

CROSS-REFERENCE TO RELATED APPLICATIONS

Figure 1:
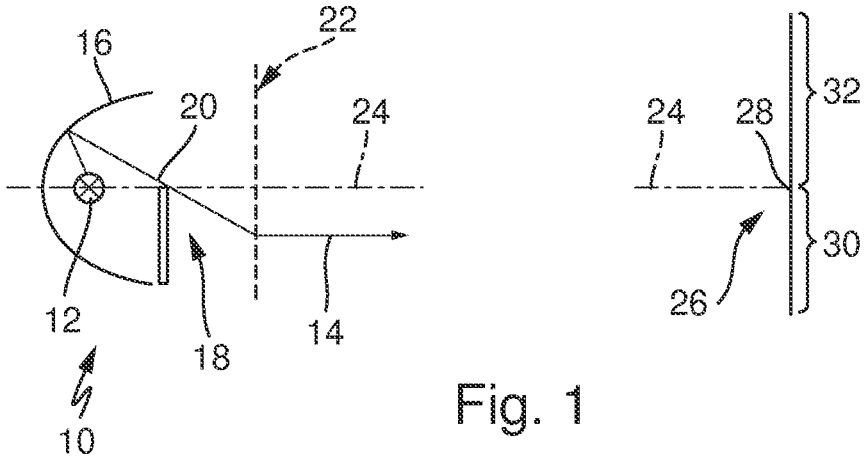

This application claims priority to and benefit of the filing date of German Patent Application 20 2011 005 617.1 filed on Apr. 27, 2011 and German Patent Application 10 2012 206 029.4 filed on Apr. 13, 2012.

BACKGROUND OF INVENTION

1. Field of Invention

The present invention is directed toward a light module and, more specifically, to a light module having an aperture with a resilient stop element.

2. Description of Related Art

Light modules known in the related art generally include a light source, a light-collecting element, a primary optics or reflector, an aperture with an actuator and secondary optics, also called projection lens. Based on the design and arrangement of the light source and the primary optics, the light module is equipped to transfer the lighting current of the light source into a first light distribution situated in a focal plane of the projection lens. Based on their design and arrangement the secondary optics is equipped to transfer the first light distribution into a second light distribution situated at the front end of the light module.

The aperture has an optically active edge also called an aperture edge. It is flexibly mounted in the light module. Using an actuator it can be moved into the first light distribution in such a way that its aperture edge restricts the first light distribution. Then the aperture edge is represented in the second light distribution as a cut-off line thus forming low beam distribution. To realize high beam distribution, the aperture is moved out of the first light distribution.

Consequently, the actuator is arranged in such a way that the optically active edge of the aperture can be moved into and out of the first light distribution. Such light modules are used in motor vehicles for the purpose of producing different light distributions at the front end of the motor vehicle. As a result, depending on the position of the optically active edge of the aperture, different second light distributions are generated, whereas not all alternatives of low beam light distribution and high beam light distribution are listed here. Where required it is possible to use intermediate positions of the aperture.

There are numerous possibilities for realizing a movable aperture edge which operate with a swivel, rotating, slide or folding mechanism. In road traffic the switch between the operating conditions of the projection module from low beam light to high beam light has to be performed in a very fast manner, i.e., within fractions of a second. Therefore, by means of actuators, the movable apertures are usually moved out of one, the initial position and are stopped by means of a fixed limit stop in another, the new position. In particular, such a limit stop defines the low beam light position of the aperture. However, the high beam light position does not necessarily require a limit stop because there the aperture does not have to be positioned in such a precise manner. Preferably, the limit stop for positioning a low beam light position is arranged at the primary optics or a structure that is rigidly connected with the primary optics in order to establish a defined position of the aperture in relation to the primary optics.

It is possible that in the interior space of the motor vehicle headlights temperatures of more than 100° C. are reached. In order to guarantee the required temperature stability and in order to guarantee the mechanical resilience required for a use in motor vehicles, the aperture, as well as the positioning limit stop usually consist of metal.

In this case, the impact of the aperture at the positioning limit stop generates an undesirable metallic noise which can be disturbing in the area surrounding the vehicle, as well as in the interior space of the vehicle. This is especially the case when the motor is not running. Moreover, when the primary optics consist of hollow, funnel-shaped reflectors, the hollow, funnel-shaped design compounds the disturbing effect by concentrating the sound waves. Also in view of a growing distribution of low-noise vehicles with electric motors, the importance of low-noise headlights is increasing.

One possibility of avoiding limit stop noises involves the use of a movable aperture mechanism in which the aperture is positioned by means of a stepping motor drive. However, this solution involves complex technology and therefore it is cost-intensive.

Against this background, the present invention is based on the objective of designing and developing a light module of a motor vehicle aperture in such a way that undesirable noises which are generated when the aperture impacts a positioning limit stop during the process of switching positions are reduced or even completely avoided.

SUMMARY OF THE INVENTION AND ADVANTAGES

The present invention overcomes the disadvantages in the related art in a projection light module including a light source, primary optics, secondary optics, and a movable aperture. These components are arranged in such a way that the primary optics transfer light current emanating from the light source in a first light distribution which is situated in a focal plane of the secondary optics so that the secondary optics transfer the first light distribution in the second light distribution situated in the front end of the light module. Moreover, the light module is equipped to displace an optically effective edge of the aperture by actuating the aperture between a first control and a second control position wherein at least the second control position is defined by a mechanical stop limit including a resilient stop element.

Additional features of the present invention are summarized below. However, those having ordinary skill in the art will appreciate that the present invention is defined by the claims set forth herein and that the following summary is not intended to be by way of limiting the scope of the invention.

In one embodiment, the stop element is designed in such a way that, after the stop element impacts a mechanical limit stop which is rigidly connected with primary optics, the resilient aperture is not lifted again. Instead, in each switching process, the stop element of the aperture should impact the limit stop only once. At the same time, there should not be an abrupt impact but a relatively soft brake resulting from a deformation of the resilient stop element. After the resilient stop element impacts the limit stop which is rigidly connected with the primary optics, the speed of the aperture should be gradually reduced until it comes to a stop. As a result, it can be reliably avoided that a repeated impact of the aperture on the limit stop generates a loud and disturbing rattling noise.

The resilient features of the at least one stop element can be achieved in different ways. In one embodiment, the stop element comprises a lever which is attached at the aperture and which consists of sheet metal or plastic material. The distal end of the lever rests in a specific position at the mechanical limit stop which is rigidly connected with the primary optics. Preferably, the dimensions of the lever, especially the distance between the distal end and a mounting point at the aperture and the strength of the lever, as well as the material of the lever are selected in such a way that the distal end has a resilient design in relation to the mounting point.

In another embodiment the stop element is designed as a leaf-spring-like sheet metal. In this case, the stop element may be punched out of a spring sheet. This allows for especially cost-effective production. It is also advantageous that such a leaf-spring sheet metal can be riveted to an available main aperture without drastically changing available constructions.

In another embodiment, an additional aperture and the stop element are designed as one piece. In this case, the additional aperture lies in the optical path behind the main aperture in such a way that the additional aperture shades part of the light propagating past the main aperture. As a result, the intensity of the low beam light is reduced locally, namely at the place where the shading is effective. Consequently, the projection light module can be optimized to maximum illumination intensities for high beam operation without having to accept high illumination values in low beam operation. In addition, depending on the position, a twin orifice implemented through the main aperture and the additional aperture allows for a specific reduction of blue or red color portions of light, which provides the possibility of improving the correction of color fringes compared with an individual aperture edge.

For example, one embodiment of a one-piece structure consisting of resilient stop element and additional aperture can be punched from a 0.2 mm spring sheet. Consequently, it is possible to implement the invention-based functionality of a resilient stop element in a simple cost-effective manner.

Furthermore, the spring rate of the stop element may be adjusted to the forces acting during actuation of the aperture. Using a stop element with a high spring rate, for example a comparatively rigid spring sheet, produces upon impact a louder noise than a stop element with a low spring rate, for example a soft spring sheet. However, it has the advantage that it produces stronger attenuation. As a result, the aperture swings about its end position with lower amplitude than would be the case when using a soft spring sheet. The spring rate is especially affected by the material of the spring and its geometry.

In one embodiment, when a no-current actuator is used, the aperture is pressed into the second control position by means of a mechanical return spring. The resilient characteristics of the return spring are adjusted to the stop element acting as stop spring. In this case, the stop spring is harder than the return spring in order to guarantee that the aperture stops at a defined position. If the return spring would be harder and the return spring has to be pre-tensioned, the return spring could permanently damage the stop spring in the stop position, which would result in inaccurate positioning.

In one embodiment, the aperture arrangement is swivel-mounted around a horizontal swivel axis. In this case, the swivel axis runs perpendicular to an optical axis of the light module and is mounted at a distance to this axis which, in turn, is mounted in a headlight for the intended purpose of the light module, which headlight is mounted in a motor vehicle, preferably arranged below the optical axis. When this type of aperture mechanism is used, it is especially easy to implement the invention-based device.

In one embodiment of the light module, the stop element is assigned to the second control position of the aperture, wherein the light module generates in the second position a dimmed light distribution, for example low-beam light distribution or the like. In one embodiment, the first control position of the aperture generates high-beam light distribution.

The light module includes a mechanical limit stop for the resilient stop element of the aperture which limit stop is rigidly connected to the primary optics. The stop element rests against the mechanical limit stop when the aperture is moved from high-beam light position to low-beam light position.

After the stop element impacts the mechanical limit stop, the aperture because of its inertial force follows its path which is predetermined by the swivel axis. In the process, kinetic energy of the aperture is converted into tension energy of the resilient stop element and ultimately via internal friction into heat, thus absorbing the vibration. While the stop element is deformed, the stop element rests, preferably continuously, i.e., always on the mechanical limit stop which is rigidly connected with the primary optics. As a result, the loud and disturbing rattling noise is reliably avoided.

The noise absorption can be further improved by providing the stop element, or the associated mechanical limit stop which is impacted by the stop element, with a noise-absorbing stop surface. For example, the stop surface can be produced from rubber or plastic material. In a preferred embodiment, the aperture can be decelerated in a specific, controlled manner without producing rattling noises by implementing in the stop element non-linear spring characteristics in that the spring force increases when the displacement increases according to progressive spring characteristics. Consequently, with increasing displacement, the aperture is abruptly decelerated, thus reducing the displacement.

Additionally, the stop element may include an attenuator having vibration-reducing characteristics. As a result, post-pulse oscillation of the aperture is kept on a low level or even avoided, so that the aperture reaches as fast as possible the end position which corresponds to the desired position.

During the switching process, the movement of the aperture usually takes place at relatively high speed. Therefore, after impacting the stop element, the aperture moves beyond the intended end position. This makes it necessary that the remaining parts of the light module are designed and arranged in such a way that the aperture can swing beyond the intended end position without impacting other parts of the light module. As a result, an unintentional stop of the aperture cannot cause abrupt blocking. For example, the free space required for this movement can be achieved by providing a recess in the primary optics designed as reflector in which recess the aperture of part of the aperture can oscillate. Preferably, the recess in the reflector is designed in such a way that the functionality of the light module is not affected, especially with regard to the optical characteristics of the reflector.

Furthermore, the limit stop may include means for adjusting a position of the limit stop in relation to the remaining parts of the light module. In one embodiment, the mechanical limit stop which is rigidly connected with the primary optics includes an adjusting screw. The end of this adjusting screw forms the limit stop and can be adjusted parallel to the moving direction of the aperture or the optical axis of the light module. In a state of rest, the aperture assumes as precisely as possible the intended end position, for example, the exact position for generating low beam light distribution with optimized correction of color fringes.

For example, in the intended end position of the aperture, in the projection of light distribution on the road, color separation of light which is caused by light dispersion and which reproduces color fringes on the road in the region of the cut-off line is reduced to the extent possible. These color fringes are perceived by the driver as disturbing and have to be reduced. Therefore the light module of the present invention is the position of the limit stop or the end position of the aperture arrangement may be adjusted in order to correct the color fringes.

BRIEF DESCRIPTION OF EACH FIGURE OF DRAWING OF INVENTION

Figure 4:
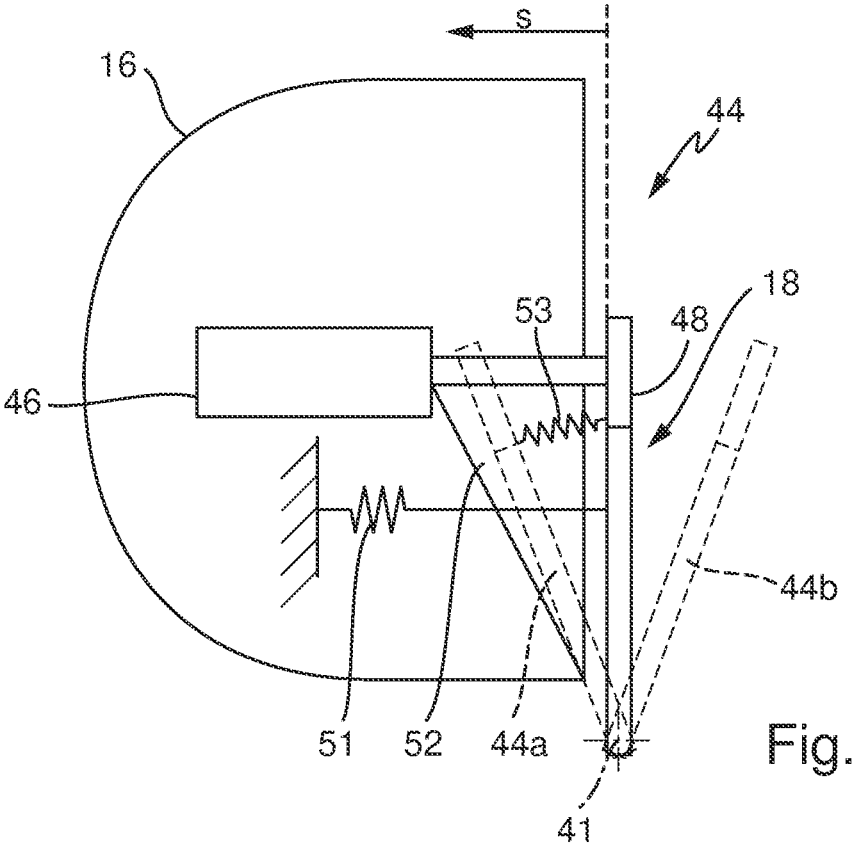
Figure 2:
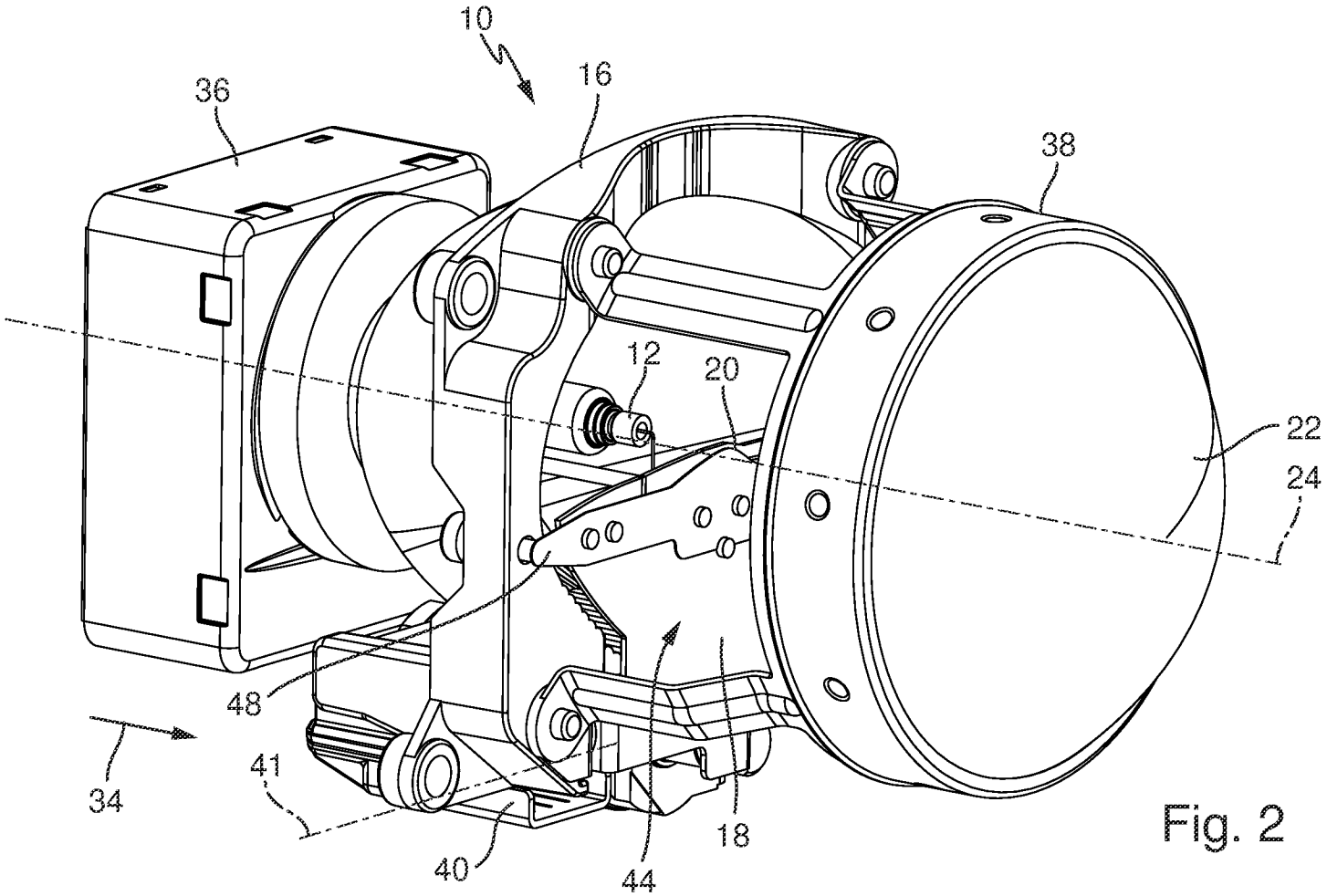
Figure 3:
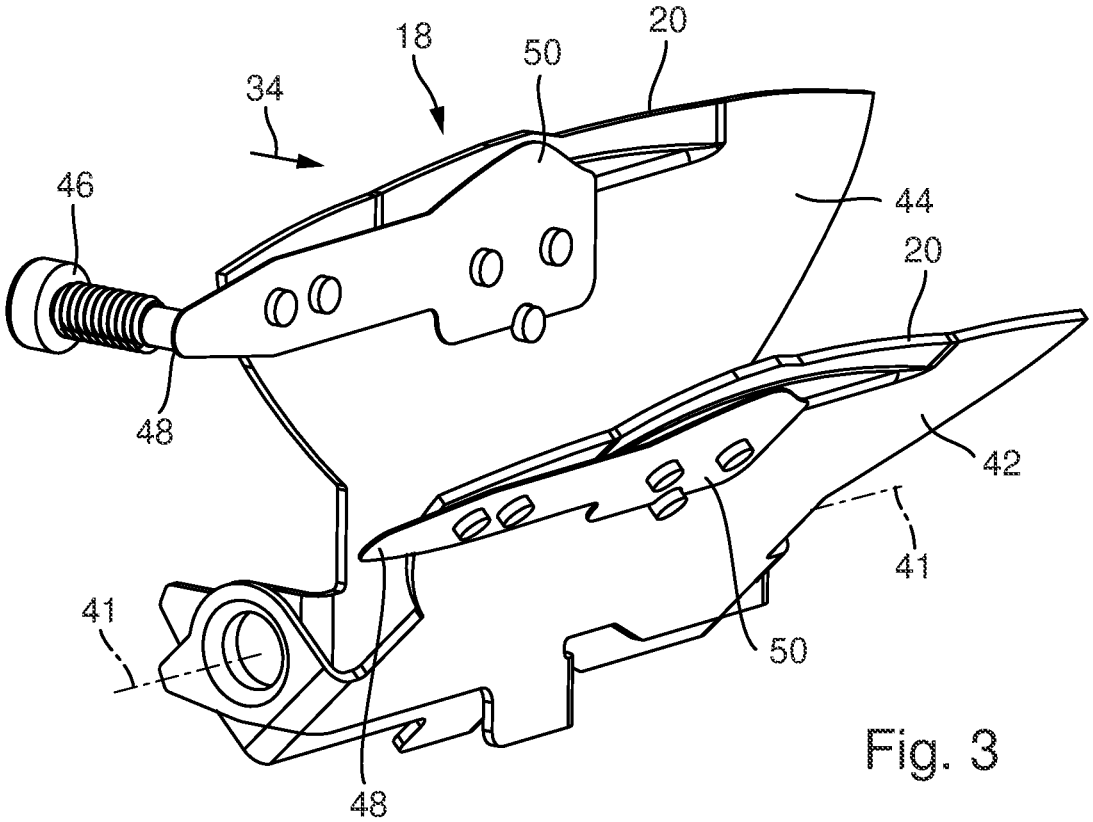

Other objects, features and advantages of the present invention will be readily appreciated as the same becomes better understood after reading the subsequent description taken in connection with the accompanying drawings wherein:

FIG. 1 is a schematic diagram illustrating an operating principle of a light module as technical environment of the invention FIG. 2 is a perspective view illustrating one embodiment of the invention-based light module FIG. 3 is a perspective view illustrating an aperture of the light module of the present invention in a first control position and in a second control position FIG. 4 is a schematic diagram of the light module shown in FIG. 2.

DETAILED DESCRIPTION OF EMBODIMENTS OF INVENTION

Referring now to FIG. 1 where like numerals are used to designate like structure throughout the figures, a schematic diagram of a light module for a motor vehicle is generally indicated at 10. The light module 10 includes a light source 12, primary optics 16 in the form of a reflector which collects light 14 of the light source 12, an aperture 18 which has an aperture edge 20, and a projection lens 22. The elements 12, 16, 18 and 22 are arranged along an optical axis 24 of the light module 10 in such a way that the element 16 collects light 14 originating from the light source 12 and directs the light on the aperture edge 20, so that a first light distribution restricted by the aperture edge 20 takes place at the aperture edge 20.

The projection lens 22 is designed and arranged in such a way that it reproduces the first light distribution as a second light distribution in a front end of the light module 10. At the same time the aperture edge 20 in the second light distribution is reproduced as cut-off line 28 between a comparatively light region 30 and a comparatively dark region 32 of the second light distribution 26.

The aperture 18 is disposed in the front end of the motor vehicle upside down and reversed. As a result, the lighter region 30 is with a light module 10 which is to fulfill low beam light function and which is mounted for its intended use in a motor vehicle below the field of vision. Because of the fact that the darker region 32 is above the field of vision a glare of the oncoming traffic is avoided or at least reduced. Usually, the aperture edge 20 has an asymmetric design and has, for example, a section that declines from the optical axis 24 to the side about an angle of 15°. The section is reproduced as an ascending edge in the second light distribution 26. As a result, the side of the vehicle facing away from oncoming traffic can be illuminated more extensively.

In a first embodiment, the light source 12 is a light bulb or a gas discharge lamp which emits light approximately isotropic. In this embodiment, the light-collecting optical element 16 may be a poly-ellipsoid reflector, i.e., a reflector which basically has an ellipsoid shape and which has a reflecting surface that restricts a reflection space filled with air in which the light spreads. Preferably the light source 12 is arranged in a focus of the ellipsoid reflector. The reflector focuses the light of the light source on the aperture edge 20 which is situated in a control position in a focal plane of the secondary optics, cutting and contacting the focal plane. The reflector 16 transfers the light emitted in isotropic manner from the light source 12 into a first light distribution which is restricted by the aperture edge 20 in low beam light position of the aperture.

In an alternative embodiment, the light source 12 is a semi-conductor light source or an arrangement of semi-conductor light sources. Usually semi-conductor light sources, especially illuminating diodes, are half-space radiation sources and differ from light bulbs and gas discharge lamps which can be considered as light sources emitting light approximately isotropic. Therefore, it is preferred to use different primary optics 16 when semi-conductor light sources are used as light source 12.

In contrast to a poly-ellipsoid reflector which more or less surrounds the light source 12, semi-conductor light sources used as light sources 12 require that the reflector is closed only on one side and basically has an ellipsoid shape. Applied to the representation shown in FIG. 1, this means that the lower half of the reflector 16 shown could be omitted.

As an alternative to such a semi-circular reflector used as primary optics, it is also possible to use for a light source 12 implemented as semi-conductor light source or an arrangement of semi-conductor light sources an optical head consisting of light-conducting material which absorbs the light 14 of the light sources 12 and by breaking the light at the light entrance surface and the light emitting surface, as well as internal total reflections taking place within the light-conducting material at its lateral interfaces collects the light 14 and directs it on the aperture edge 20.

In one embodiment, the secondary optics 22 is a collective lens which is arranged in a way that its reflector-facing focal point in the region of the first light distribution is situated at the aperture edge 20. The aperture edge 20 is then reproduced in the front end of the motor vehicle as a strong cut-off line 28 in the second light distribution 26.

FIG. 2 shows an isometric representation of the invention-based light module 10 according to one embodiment. By means of an arrow 34 a main light exit direction is epitomized showing the intended use in a motor vehicle headlight. Preferably this main light distribution direction corresponds to the forward direction of the motor vehicle.

In this first embodiment, the light module 10 comprises a gas discharge lamp as light source, including a bulb 12 and a starting device 36, as well as a hollow reflector as primary optics 16. One edge of the reflector 16 includes a support frame 38 which keeps the reproducing secondary optics 22 at a specific distance.

The aperture 18 is arranged between the projection lens 22 and the reflector 16. In FIG. 2, the aperture 18 is shown in a second control position 44 as will be described in greater detail below. An actuator 40 is arranged and rigidly connected with the support frame 38 below the reflector 16. The actuator 40 has a movable element which is coupled with the aperture 18. The aperture 18 is mounted around a basically horizontal swivel axis 41 which runs perpendicular to the optical axis 24 of the light module 10.

In one embodiment, the light module 10 in its entirety is arranged in such a way that it can swivel about two axes mounted perpendicular to each other in the headlight of a motor vehicle. For their intended use in a motor vehicle one of the axes has a horizontal design and the other one a vertical design. Swiveling about the horizontal axis allows for a headlight range adjustment. Swiveling about the vertical axis allows for an adaptive headlight function in which the lighting direction with the light module can be swiveled to the right or to the left following the steering angle when the car drives around curves. It is also possible to vary the width of light distribution, which results from the sum of light distributions of the right and left headlight, by varying the angle which involves the lighting directions of both headlights.

In one embodiment, the actuator 40 is implemented as an electro-magnetic magnet which is designed to move a movable element, for example a tension anchor, into a previously specified position and to keep it in this position. In one embodiment, the predetermined position is defined by a mechanical limit stop.

Independent of the design of the actuator 40, each different position of the aperture edge 20 is defined by the end positions of the actuator 40. As a result, particularly the positions of cut-off lines are defined by mechanical limit stops of the actuator 40, which allows for a precise and reproducible adjustment of the position of cut-off lines. A simple tension anchor comprises a first limit stop for an extended position and a second limit stop for a retracted position of the tension anchor. The retracted position corresponds to a high beam light position or first control position 42 of the aperture edge 20, while the extended position corresponds preferably to a low beam light position or second control position 44 of the aperture edge 20.

The second control position 44 is assumed in a no-current state of the actuator 40 in which the tension anchor is kept in this position by a pre-tensioned return spring. From this low beam light position 44, the tension anchor is moved against the reset force of the return spring when a high beam light position 42 of the aperture 18 has to be adjusted. This has the advantage that reset forces are increased during a transition from the low beam light position 44 to the high beam light position 42. As a result, an automatic return into the low beam light position 44 is triggered when the actuator 40 is not causing a displacement in the other direction. This has the advantage that a simple actuator 40, for example a magnet, can be used which can apply its actuating force in only one direction. Consequently, the return movement is actuated by resilient reset forces.

A further advantage involves the fact that the resilient reset forces trigger a return into the low beam light position 44 when the actuator 40 is not able to apply power, which could be the case, for example, when the actuator is defective. For example, an interruption of the power supply of a magnet used as actuator 40 automatically results in the fact that a low beam light position is approached, thus avoiding a glare of oncoming traffic.

In road traffic it is required that the switch between low beam light position 44 and high beam light position takes place quickly, i.e., within fractions of a second. Therefore it is necessary to greatly accelerate the aperture 18 by means of the reset forces. In this embodiment, an adjustable mechanical limit stop 46, designed as an adjusting screw, defines the end position of the aperture 18 in the second control position 44.

In one embodiment, the adjusting screw is fixed when the adjustment has been made. In this case, the screw thread may be coated with varnish or plastic material or a material that is hardened in a different manner, resulting in a self-locking effect of the screw. In one embodiment, the screw thread in the aperture is pressed and/or cut into the hardened material, for example varnish, when the screw is inserted. Consequently, the screw can be removed again but, at the same time, it is fixed in its position, thus avoiding undesirable changes in the defined limit stop position. It is also possible to use glue or implement the thread at the aperture mechanism analogous to the standardized self-locking screw nut.

To soften the impact on the mechanical limit stop 46 and to absorb the corresponding noise, which is heard as a metallic clicking, the aperture has a stop element 48. FIG. 3 shows a detailed view of the invention-based aperture 18 including stop element 48 and limit stop 46. The isometric representation shows the aperture 18 in two control positions 42 and 44. In the second control position 44, the stop element 48 rests against the mechanical limit stop 46. Here the stop element is designed as a leaf-spring-like sheet metal which is riveted to the main aperture or attached in a different manner. In one embodiment, the leaf-spring-like spring sheet may have a sheet thickness of between 0.1 mm and 0.3 mm, particularly between 0.15 mm and 0.25 mm and is preferably thinner than the material of the aperture.

The stop element 48 extends beyond the edge of the aperture 18, resulting in a flexibly deformable lever arm between the limit stop 46 and the adjacent anchorage point 49 in which the stop element 48 is attached at the aperture 18.

In this embodiment, the stop element 48 forms one piece with an additional aperture 50. However, this is not mandatory. It is also possible to use a multi-piece design in which the additional aperture 50 and the stop element 48 are arranged at the aperture 20 as separate pieces. In the object shown, the design as additional aperture results from the fact that one edge of the spring sheet protrudes into the distribution of the light propagating past the aperture edge 20 of the aperture 18. FIG. 3 shows a preferred embodiment in which the optically effective aperture edge 20 of the aperture 10 forms a curvature out of the plane of the aperture 18. However, the leaf-spring-like attachment, which is used as additional aperture 50 and as stop element 48, is arranged inside the plane of the aperture 18.

As a result, there is a distance along the main light distribution direction 34 of the light between the optical effective aperture edges of the aperture 18 and additional aperture 50 which, in this case, are used as main aperture. This distance is important for the desired reduction of color fringes at the cut-off line because they are associated with the so-called longitudinal chromatic aberration of the reproducing secondary optics. (The focal points of the secondary optics for light proportions of different color do not coincide on the optical axis, but occur at a distance from each other.)

In a further embodiment, the stop element 48 may include a leaf-spring-like spring sheet without optical function. The additional aperture 50 is connected at the aperture 18 in such a way that it results in the optical functions (described above) of a correction of color fringes and/or a local reduction of the low beam light intensity in the second light distribution. FIG. 4 provides a description of the functionality of the stop element.

FIG. 4 shows a schematic lateral view of a reflector as primary optics 16, the mechanical limit stop 46, which can be adjusted by means of an adjusting screw and which, apart from the adjustment by means of an adjusting screw, is rigidly connected with the primary optics 16, and the aperture 18 which is swivel-mounted about the swivel axis 41. The position of the aperture 18 shown as solid lines corresponds to the second control position 44. In the embodiment shown, the movement of the aperture 18 from the first control position **44*b* into the second control position 44 is powered by a return spring 51, which is attached with one end to the aperture 18 and with the other end at the primary optics 16. A spring 53, depicted as a coil spring in FIG. 4 merely for the purpose of demonstration, represents a spring force applied by the stop element 48 during the process of flexible deformation. The spring forces of the springs 51 and 52** are arranged in opposite direction or have at least opposite direction components.

The aperture 18 moved out of the first control position 44*b* impacts with its resilient stop element 48 the mechanical limit stop 46 in its second control position 44. Because of the spring characteristics of the stop element 48 and the inertial forces of the aperture 18, the aperture 18 moves to a particular position 44*a*, wherein the preferably leaf-spring-like stop element 48 is deformed. In the schematic view of FIG. 4, this corresponds to an extension of the spring 53.

As a result of this deformation, the stop element 48 absorbs kinetic energy of the aperture 18 and decelerates the aperture up to a standstill. In the process, the tension in the stop element 48 increases with the displacement of the aperture 18 from the second control position 44 measured in the direction of position 44*a* until the movement direction of the aperture 18 is reversed under the influence of the resulting spring forces (stop spring 53 and return spring 51). In the process, the reset forces of the actuator 40, which press the aperture 18 into the desired second control position 44, counteract the force of the resilient stop element. As a result, the aperture 18 swings with decreasing amplitude repeatedly through its end position. In case of strong attenuation, the movement can also correspond to an aperiodic borderline case.

As a result of the flexible absorption of the kinetic energy, the energy dissipation is prolonged over time which has a desired absorbing effect and reduces the generation of impact noises. As far as possible, the absorbing characteristics of the stop element 48 prevent the aperture 18 from overshooting the second control position 44, for example into the position 44*a* or back into the position 44*b*. At the same time, the return spring springs back and counteracts the possibility that the stop element is lifted from the limit stop and, in an ideal case, prevents that the stop element is lifted from the limit stop, which can be controlled by adjusting the spring effects of the stop element 48 and the return spring. As a result, the disturbing rattling noise is effectively avoided.

The reflector as primary optics 16 comprises a recess 52 in a movement region of the aperture 18 in order to provide the free space required if the aperture 18 overshoots the second control position 44, for example into the position 44*a* at least along the displacement s of the stop element 48. In order to attain the free space required for the displacement s of the stop element 24, it can be necessary to remove from the region also other parts of the light module 10.

As indicated in FIGS. 2 and 3, the mechanical limit stop 46 includes a screw element which is used as an adjusting screw for adjusting a horizontal position of the mechanical stop element 46. As a result, the second control position 44, which impacts the aperture 18 or the stop element 48, is also adjusted and, consequently, also the precise position of the aperture edge 20 of the aperture 18 in the second control position 44.

The present invention is used to describe the process of switching the apertures 18 from the first control position 42 into the second control position 44. It is also possible that a respective stop element 48 is assigned to the first control element alternatively or in addition to the stop element 48 assigned to the second control position 44. Moreover, the stop element 48 can also be designed in a way different from the embodiment described, and it can be arranged at a different position of the light module 10. It is important that the stop element 48 is designed in resilient manner in movement direction of the aperture 18 in the proximity of the control positions 42 and 44. For example, to improve the noise reduction or noise prevention, the mechanical limit stop 46 could be provided with a flexible limit stop consisting of rubber or plastic material. In one embodiment, such a limit stop has an absorbing design so that vibrations of the aperture after the aperture impacts the limit stop can subside as quickly as possible.

A further embodiment provides instead of the leaf-spring-like stop element a coil spring which rests against the limit stop 46 in the second control position and which is attached at the aperture 18 by means of a lever which is more rigid than the leaf-spring-like stop element 48. However, otherwise it has the same design and is attached in the same way than the leaf-spring-like stop element 48.

Up to this point, the invention in this application was described with regard to a limit stop which defines an individual position of the aperture, in particular a low beam light position. However, in light modules having several limit stops, each of which defines a different aperture position, the invention can also be applied to more than one of the several limit stops or even for all of the several limit stops, for example for a low beam light position and a high beam light position, possibly alternatively or in addition even for implementing a high beam light position, one or several intermediate positions of an aperture. In particular, the invention can be used in one or several end positions of the aperture and/or in one or several intermediate positions of such an aperture. For example, in the DE 10 2010 062 278, the applicant disclosed an aperture adjustment with intermediate positions.

The invention has been described in an illustrative manner. It is to be understood that the terminology that has been used is intended to be in the nature of words of description rather than of limitation. Many modifications and variations of the invention are possible in light of the above teachings. Therefore, within the scope of the appended claims, the invention may be practiced other than as specifically described above.

What is claimed is:

1. A projection light module comprising:

a light source, primary optics, secondary optics and an aperture arranged between the primary optics and the secondary optics that is movable, by an actuator, between a first control position and a second control position, wherein the light module includes a resilient stop element and a mechanical limit stop for the resilient stop element, which limit stop is rigidly connected to the primary optics and wherein the mechanical limit stop includes an adjusting screw for adjusting a position of the limit stop in relation to the remaining parts of the light module.

2. The light module as set forth in claim 1, wherein the resilient stop element (48) forms one piece with an additional aperture (50).

3. The light module as set forth in claim 1, wherein the resilient stop element is a leaf-spring-like spring sheet.

4. The light module as set forth in claim 1, wherein the aperture is swivel-mounted around a horizontal swivel axis.

5. The light module as set forth in claim 1, wherein the resilient stop element is assigned to a second control position of the aperture.

6. The light module as set forth in claim 1, wherein the first control position of the aperture the light module produces high beam light distribution.

7. The light module as set forth in claim 1, wherein the second control position of the aperture the light module produces low beam light distribution.

8. The light module as set forth in claim 1, wherein the resilient stop element includes means for adjusting a position of the stop element in relation to the remaining parts of the light module and, consequently, also in an end position of the aperture in the control position assigned to the stop element.

* * * * *